US006000985A

United States Patent [19]

Yeh

[11] Patent Number: 6,000,985

[45] Date of Patent: Dec. 14, 1999

[54] CUP

[75] Inventor: Mel-Fen Su Yeh, Yung Kang, Taiwan

[73] Assignee: Wea Bor Co., Ltd., Tainan, Taiwan

[21] Appl. No.: 09/136,058

[22] Filed: Aug. 19, 1998

[51] Int. Cl.[6] ..... A63H 33/26

[52] U.S. Cl. ..... 446/129; 446/71; 446/175; 446/236

[58] Field of Search ..... 446/71, 74, 77, 446/129, 133, 175, 236, 243; 215/396, 398, 400; 206/217, 457

[56] References Cited

U.S. PATENT DOCUMENTS

| | | | |
|---|---|---|---|
| 2,441,607 | 5/1948 | Walls | 446/246 |
| 5,275,277 | 1/1994 | Gallegos | 206/457 |
| 5,314,365 | 5/1994 | Chen | 446/133 |
| 5,525,383 | 6/1996 | Witkowski | 206/457 |
| 5,913,442 | 6/1999 | Wu | 206/457 |

*Primary Examiner*—D Neal Muir
*Assistant Examiner*—Jeffrey D. Carlson
*Attorney, Agent, or Firm*—Rosenberg, Klein & Lee

[57] ABSTRACT

A cup consists of an inner body, an outer body and a rotatable base located between a hollow space formed between the inner body and the outer body. The rotatable base has a decorative paper and a plurality of magnets facing coils contained in an annular groove opening to the bottom of the outer body. A battery unit, a control circuit and the coils are contained in the annular groove. When the coils are energized by electricity of the battery unit, then the rotatable base together with the decorative paper is rotated by repelling force of magnetic fields produced by the coils interacting with the magnets of the rotatable base.

3 Claims, 6 Drawing Sheets

CUP

BACKGROUND OF THE INVENTION

This invention relates to a cup, particularly to one having a rotatable disc provided in an outer body rotated by magnetic fields produced by coils and magnets provided on the rotatable disc located between the outer body and an inner body, producing interesting effect to attract consumers' curiousity.

At present most cups are made of one layer with monotonous shapes, and some are made of an outer body and an inner body with an intermediate hollow space filled with a liquid mixed decorative small pieces and golden bits as beautifying means. However, those kinds of cups are no longer so attractive to appeal to consumers' purchasing power.

SUMMARY OF THE INVENTION

The purpose of the invention is to offer a kind of cup having a picture or a pattern adhered on an outer surface of an inner body, and a rotatable disc with a decorative paper to be rotated by means of repelling force produced by magnets and coils located to face the magnets for interacting with each other, and a battery unit contained in an annular groove formed in the bottom portion of the outer body for supplying electricity to a control circuit and the coils. The bottom surface is closed with an annular cover with an aperture facing the the battery unit and closed with a swing cap for placing the battery unit therein. Then when the coils are energized by the battery unit and produces magnet fields to repel the magnets, the rotatable disc with the decorative paper is rotated.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
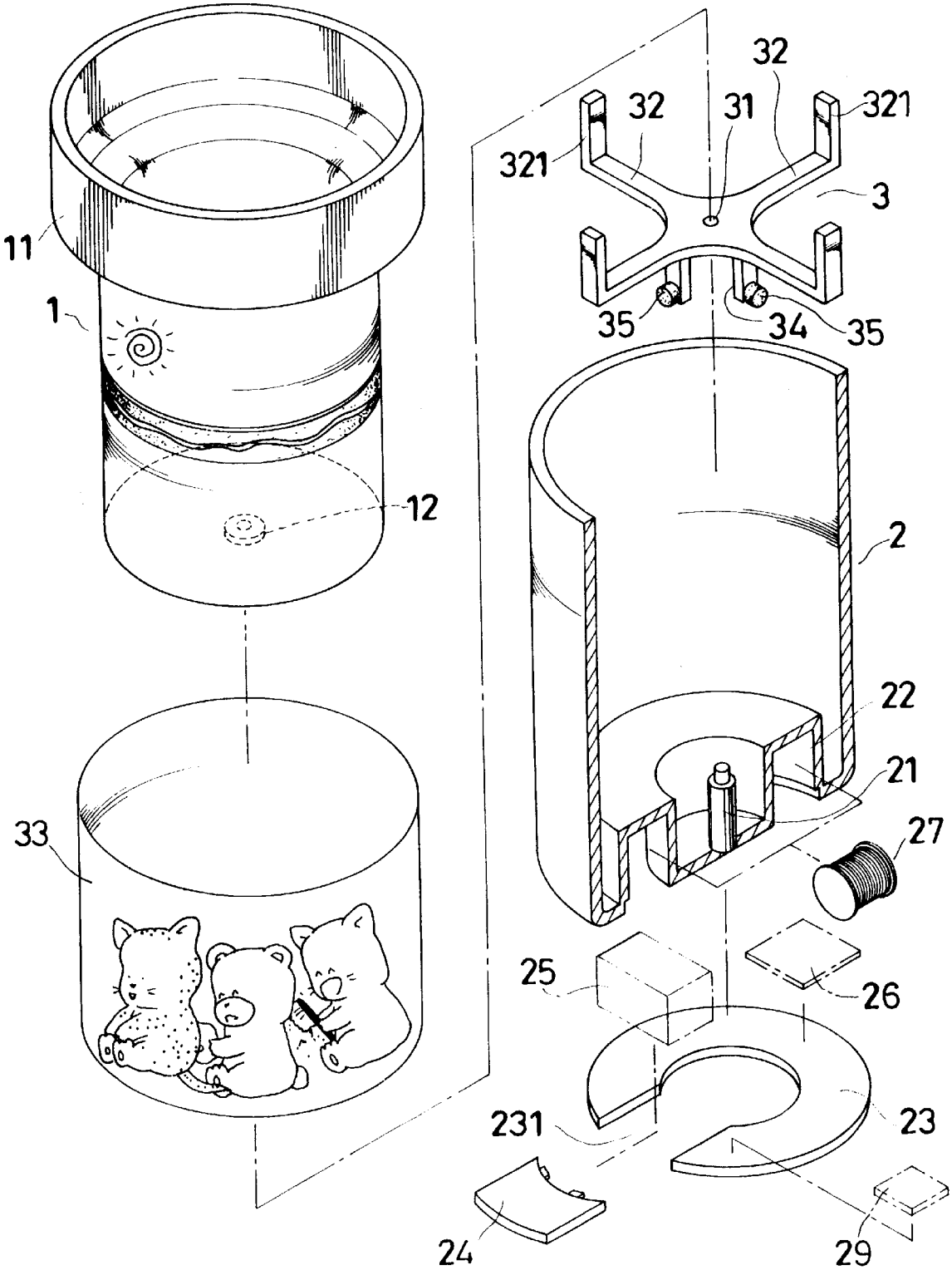
FIG. 1 is an exploded perspective view of a first embodiment of a cup of the present invention.
Figure 3:
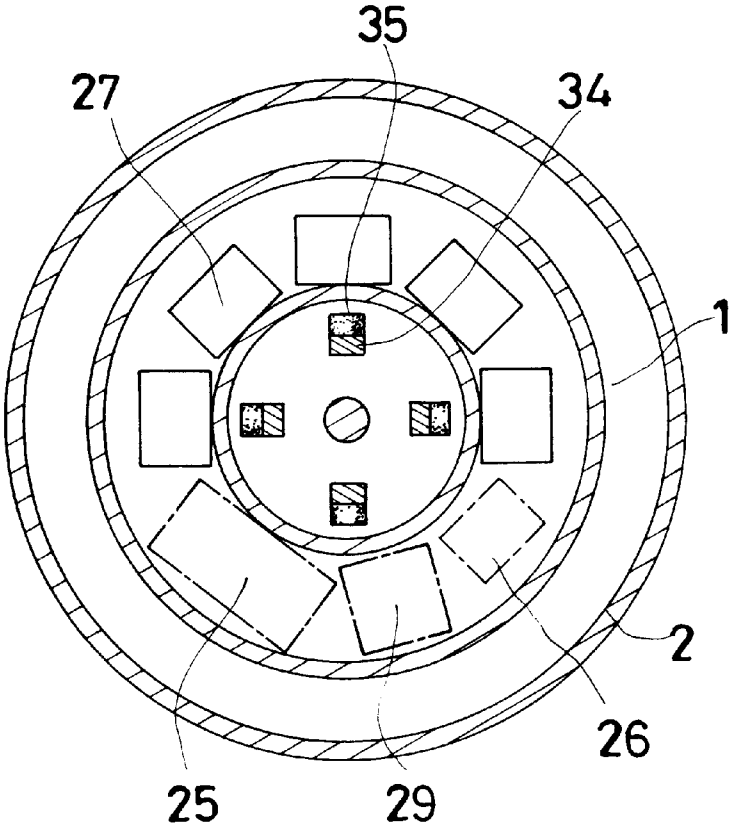
FIG. 3 is an upper view of the first embodiment of the cup of the present invention.
Figure 2:
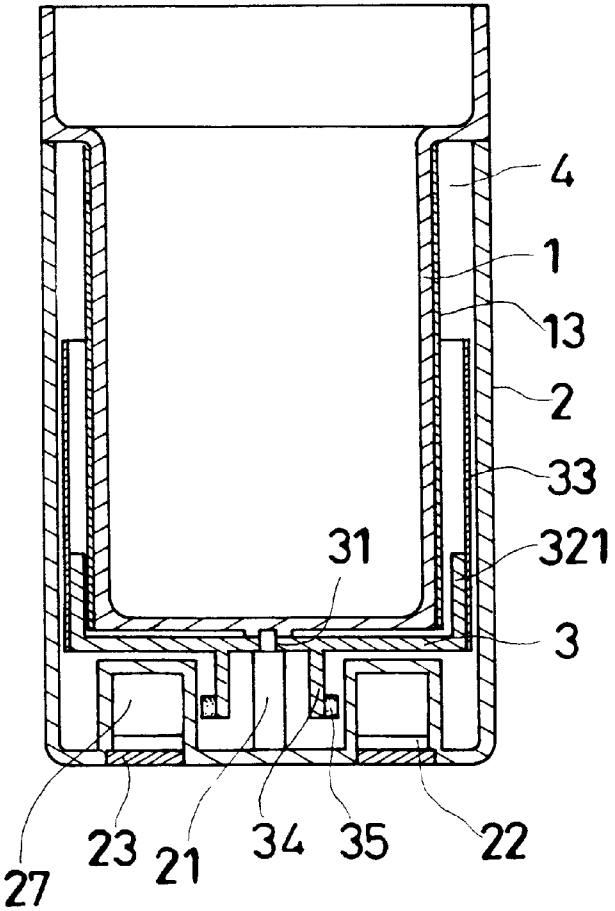
FIG. 2 is a side cross-sectional view of the first embodiment of the cup of the present invention.

A first embodiment of a cup in the present invention, as shown in FIGS. 1, 2 and 3, includes an inner body 1, an outer body 2 and a rotatable base 3 as main components.

The inner body 1 has an upper large diameter portion 11 and a lower small diameter portion, a center recess 12 formed in a bottom for an upright post 21 of the outer body 2 to fit therein, and a picture 13 adhered on an outer surface.

The outer body 2 has the upright post 21 extending up from the center of a bottom to fit in the center recess 12 of the inner body 1, an annular groove 22 formed in a lower portion opening to the bottom surface around the upright post 21, an annular bottom cover 23 fitting firmly in an opening of the annular groove 22 and having an aperture 231, a swing cap 24 fitted in the aperture 231 just on a battery unit 25 contained in the annular groove 22 so as to place the battery unit 25 in the annular groove 22.

Figure 4:
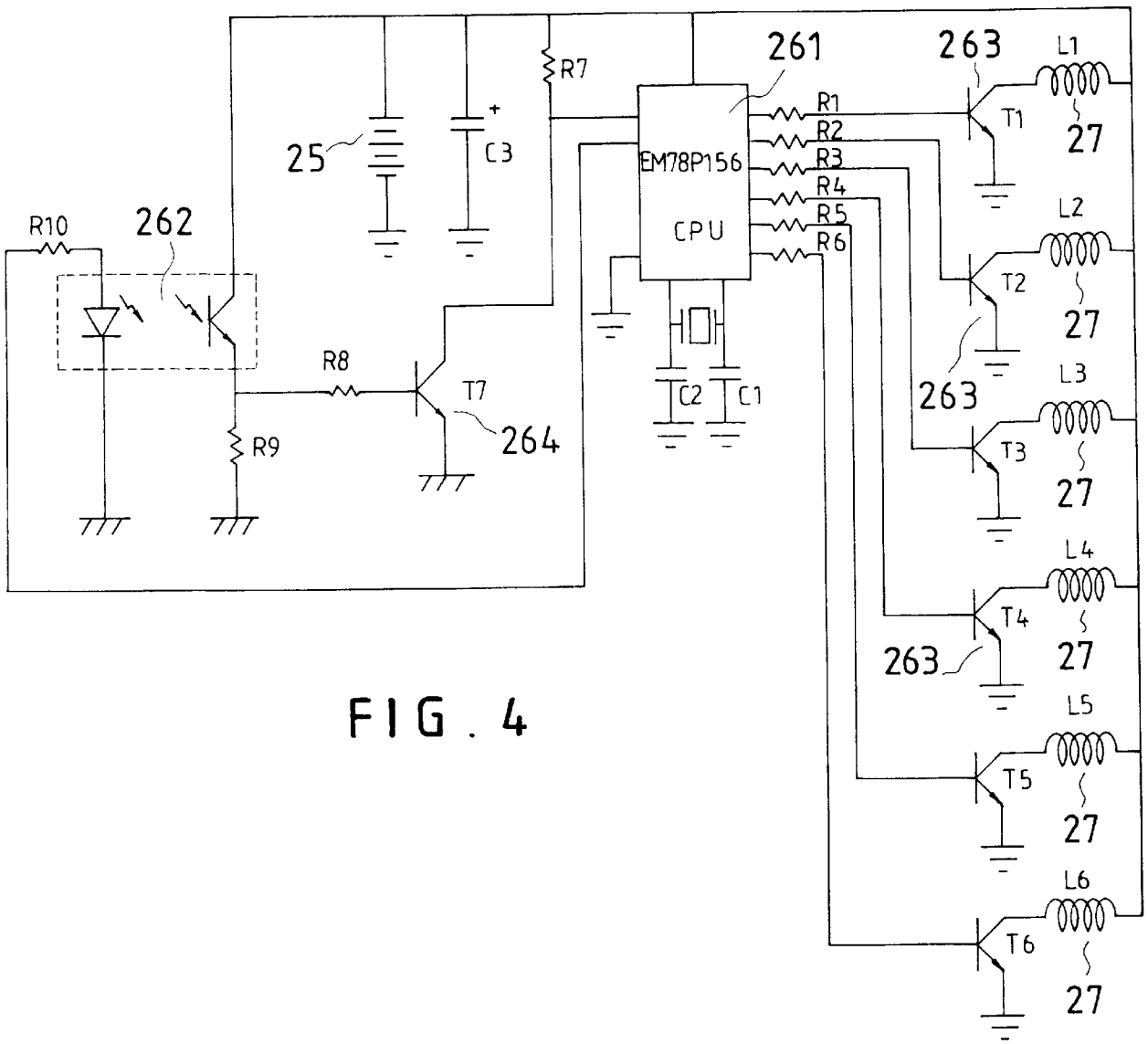
FIG. 4 is a diagram of a control circuit of the cup of the present invention.
Figure 5:
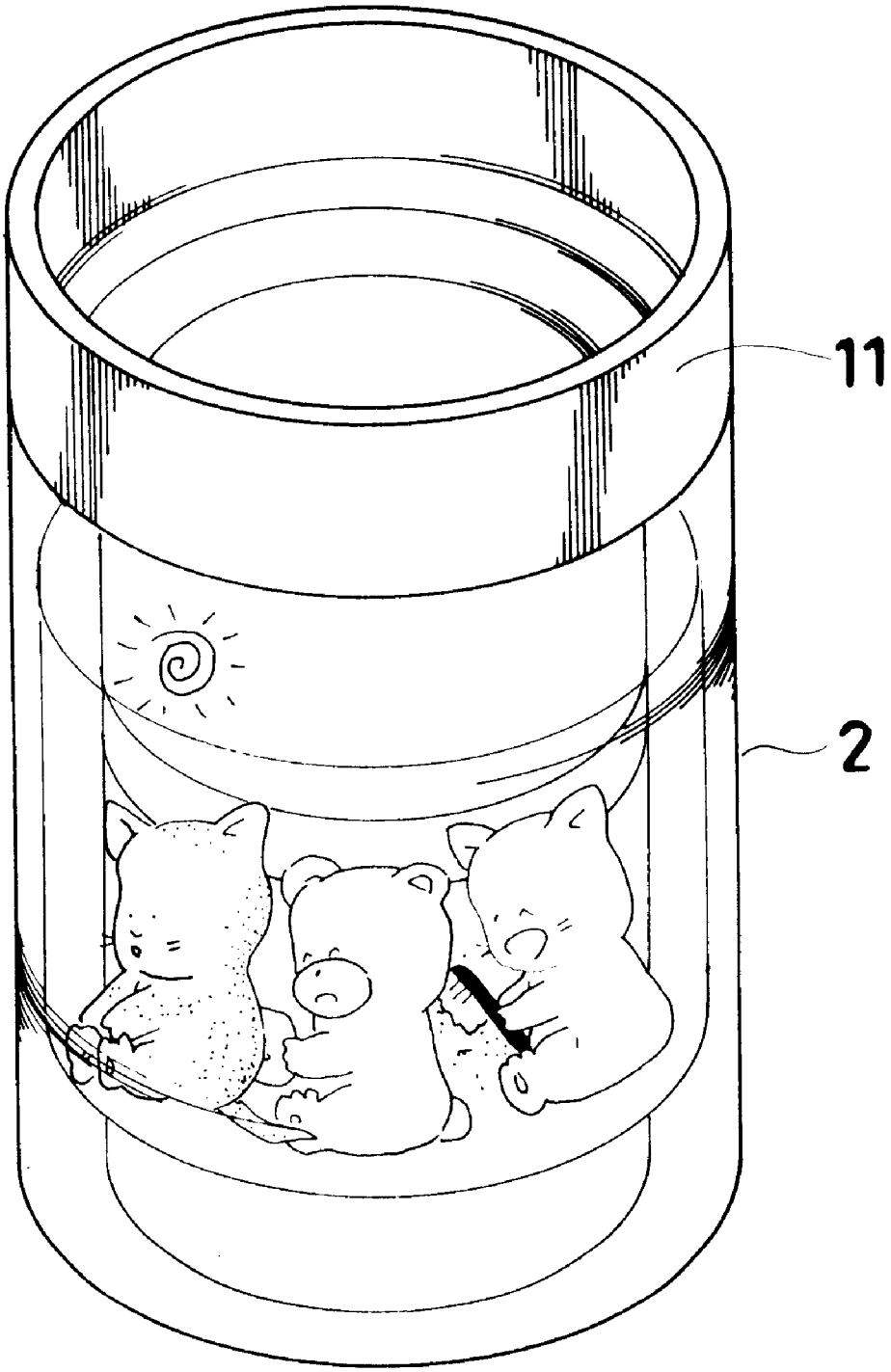
FIG. 5 is a perspective view of the first embodiment of a cup of the present invention.

Further, a control circuit 26 and a plurality of coils 27 are placed in the annular groove 22. The control circuit 26 consists of a CPU 261 (EM78P156), a phototransistor 262 and a plurality of transistors 263, 264 as shown in FIG. 4. The CPU 261 and the phototransistor 262 and the battery unit 25 are connected with one another, so when the collector of the phototransistor 262 receives signals from an emitter, the battery unit 25 supplies electricity to the CPU 261 and the control circuit 26. Then the CPU 261 turns on the coils 27 connected to the related transistors 263 connected to outputs of the CPU 261.

The rotatable base 3 has a center hole 31 for the tip of the upright post 21 of the outer body 2 to fit therein, a plurality of legs 32 extending radially from the center part, and an upright foot 321 formed at an end of each leg 32 for keeping a picture paper 33 in an area (a circle) defined by the legs 32, a plurality of feet 34 extending down from the center part, a magnet 35 fixed sidewise on the lower end of each foot 34 facing just each coil 27.

In assembling, firstly, the outer body 2 is combined with the rotatable base 3, with the upright post 21 passing through the hole 31 of the rotatable base 3 and further fitting in the center recess 12 of the inner body 1 in assembling with the inner body 1. Then an intermediate hollow space 4 is formed between the inner body 1 and the outer body 2, and the decorative paper 33 is then located in the hollow space 4.

When the cup is placed on a table, the phototransistor 262 is triggered by light reflected by a table surface, turning on the transistor T7 264 to let the CPU 261 begin to operate to turn on orderly the transistors 263, as shown in FIG. 4. Then the transistors 263 orderly turn on and off in a rotary mode, permitting the coils 27 also turned on and off to produce circulatory rotating magnetic fields, which form a repelling force against that produced by the magnet 35 on the rotatable base 3. Then the rotatable base 3 may be rotated by the repelling force, with the decorative paper 33 also rotating, giving rise to an interesting effect in contrast to the picture 13.

When the cup is picked up with a hand and taken off the table, the collector of the phototransistor 262 cannot receive light given out by the emitter, turning off the phototransistor 262. Then the CPU does not operate, with the transistors 263 also not functioning, cutting off all the coils 27. Thus, the rotatable base 3 cannot be rotated by the repelling force disappeared by means of no magnetic fields produced by the coils 27.

If the rotatable base 3 is wanted to rotate again, then the cup has to be placed on the table, permitting the phototransistor 262 operate by light, with the collector receiving electric current given out by the emitter.

Further, a music IC 29 may be connected to the control circuit 26, for turning on and off the music IC 29 by means of the phototransistor 262. Then if the phototransistor 262 functions, the rotatable base 3 begins to rotate and the music IC is also turned on to give out music. Then when the phototransistor 262 does not receive a signal, the rotatable base 3 together with the music IC 29 will be stopped.

Figure 6:
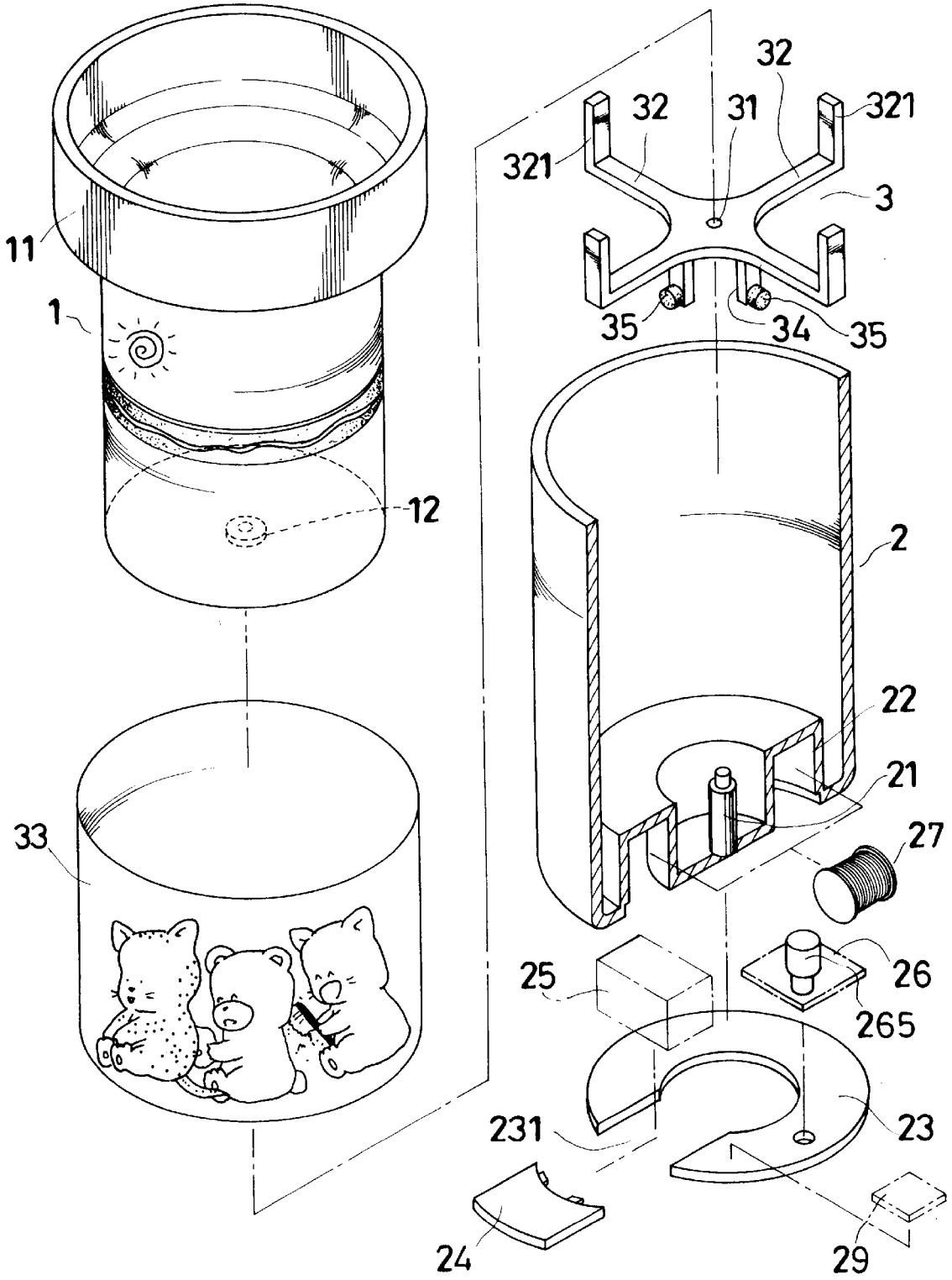
FIG. 6 is an exploded perspective view of a second embodiment of a cup of the present invention; and, FIG. 7 is a diagram of a control circuit of the second embodiment of a cup of the present invention.
Figure 7:
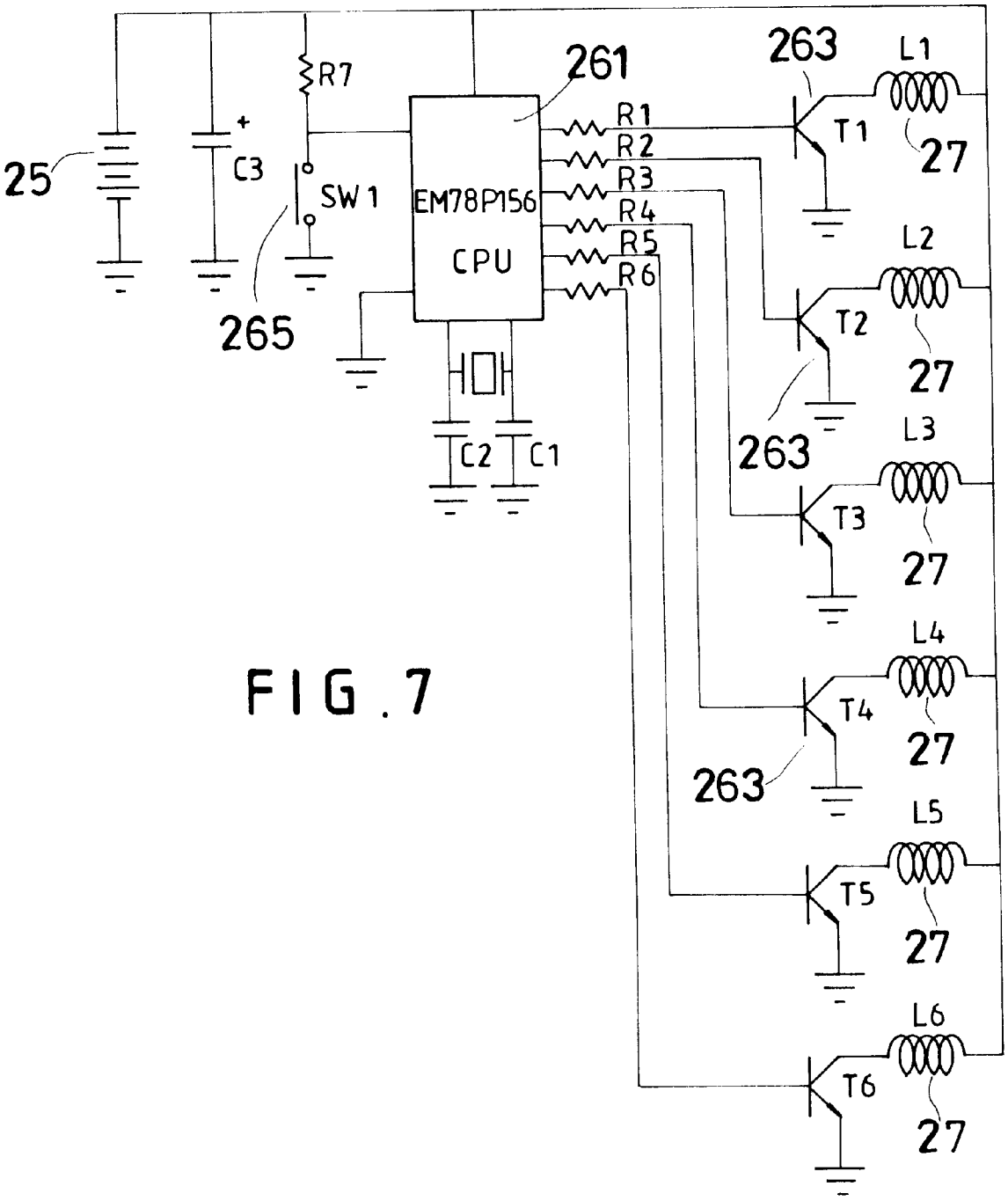

In a second embodiment shown in FIG. 6, a press switch 265 can be provided to take place of the phototransistor 262 as shown in FIGS. 6 and 7, for turning on and off the press switch 265 by placing the cup on a table or taking the cup off the table so that the CPU 261 may be turned on and off.

Further, a program may be added in the CPU 261 of the control circuit 26 for setting the time for each coil 27 and all the coils 27, and the rotating speed and the rotating time of the rotatable base 3. Then if the rotating time of the rotatable base 3 is set two minutes, the rotatable base 3 will stop after rotating for two minutes. And if it is wanted to rotate again, the cup is taken off the table and put it there again.

What is claimed is:

1. A cup comprising:

an inner body having an upper large diameter portion, a lower small diameter portion, and a center recess formed in a bottom;

an outer body having the same diameter of said upper large diameter portion of said inner body to be assembled around said inner lower small diameter portion of said inner body, and an upright post extending up from a center of its bottom;

a picture is adhered on an outer surface of said lower small diameter portion of said inner body, an annular groove is formed in a lower portion of said outer body, an annular bottom cover has an aperture and closes on said annular groove, a swing cap is fitted in said aperture, a battery unit is placed in said annular groove under said swing cap, a control circuit and a plurality of coils are contained in said annular groove, and said control circuit has a CPU, a phototransistor and a plurality of transistors;

a rotatable base having a center hole, a plurality of legs extending outward radially from the center part of said rotatable base, each said leg having an upright foot formed at its end for a decorative paper to fit in a circle defined by all said feet, a plurality of vertical feet extending down from said center part and respectively having a sidewise magnet fixed at a lower end to face each said coil contained in said annular groove of said outer body; and, said upright post of said outer body inserting through said hole of said rotatable base and further fitting in said center recess of said inner body, an annular hollow space formed between said inner body and said outer body, a decorative paper located in said hollow space whereby, turning on and off of said phototransistor and operation of said control circuit orderly energizes said coils to produce a rotary magnetic field and repel said magnet of said rotatable base so that said rotatable base rotates thereby.

2. The cup as claimed as claim 1, wherein a music IC is additionally connected to said control circuit, and turned on and off by means of said phototransistor to give out or stop music.

3. A cup comprising:

an inner body having an upper large diameter portion, a lower small diameter portion, and a center recess formed in a bottom;

an outer body having the same diameter of said upper large diameter portion of said inner body to be assembled around said inner lower small diameter portion of said inner body, and an upright post extending up from a center of its bottom;

a picture is adhered on an outer surface of said lower small diameter portion of said inner body, an annular groove is formed in a lower portion of said outer body, an annular bottom cover has an aperture and closes on said annular groove, a swing cap is fitted in said aperture, a battery unit is placed in said annular groove under said swing cap, a control circuit and a plurality of coils are contained in said annular groove, and said control circuit has a CPU, a press switch and a plurality of transistors;

a rotatable base having a center hole, a plurality of legs extending outward radially from the center part of said rotatable base, each said leg having an upright foot formed at its end for a decorative paper to fit in a circle defined by all said feet, a plurality of vertical feet extending down from said center part and respectively having a sidewise magnet fixed at a lower end to face each said coil contained in said annular groove of said outer body; and, said upright post of said outer body inserting through said hole of said rotatable base and further fitting in said center recess of said inner body, an annular hollow space formed between said inner body and said outer body, a decorative paper located in said hollow space whereby, turning on and off of said press switch and operation of said control circuit orderly energizes said coils to produce a rotary magnetic field and repel said magnet of said rotatable base so that said rotatable base rotates thereby.

* * * * *